United States Patent [19]

Périard et al.

[11] Patent Number: 4,710,307

[45] Date of Patent: Dec. 1, 1987

[54] PICKLING AGENT

[75] Inventors: Jacques Périard, Sins; Alain Cron, Hildesrieden, both of Switzerland

[73] Assignee: Lonza Ltd., Gampel, Switzerland

[21] Appl. No.: 895,384

[22] Filed: Aug. 11, 1986

Related U.S. Application Data

[63] Continuation-in-part of Ser. No. 757,307, Jul. 22, 1985, abandoned.

[30] Foreign Application Priority Data

Jul. 23, 1984 [CH] Switzerland ..... 3570/84

[51] Int. Cl.[4] ..... C10M 125/00

[52] U.S. Cl. ..... 252/18; 252/25; 252/28; 252/29; 252/30; 252/42; 252/11

[58] Field of Search ..... 252/18, 25, 29, 30, 252/28, 42, 11

[56] References Cited

U.S. PATENT DOCUMENTS 3,198,735 8/1965 Lamson et al. ..... 252/30
3,244,625 4/1966 Silwones ..... 252/28
3,912,639 10/1975 Adams .
4,039,337 8/1977 Brown et al. .
4,088,585 5/1978 Karpen .
4,104,178 8/1978 Jain et al. .
4,402,838 9/1983 Eguchi et al. ..... 252/28

*Primary Examiner*—Jacqueline V. Howard
*Attorney, Agent, or Firm*—Fisher, Christen & Sabol

[57] ABSTRACT

Agent for the pickling of and as an antioxidant for workpieces made of iron and steel in the case of when they are subjected to non-cutting, hot transformation. The agent is used in dry form. The agent contains: (a) 20 to 80 percent by weight of a pickling-effective compound, such as, sodium metaborate; (b) 1 to 80 percent by weight of a component, such as, graphite; and (c) zero to 79 percent by weight of at least one substance selected from group (d), (e) and/or (f). Zero to 35 percent by weight of group (d), such as, coke, can be used as substance (c) and, for example, act as antioxidants. Zero to 50 percent by weight of group (e), such as, sodium chloride, can be used as substance (c), and control the physical characteristics. Zero to 5 percent by weight of group (f), such as, ammonium chloride, can be used as substance (c) and, for example, act on the reduction of the oxides of group (a).

28 Claims, No Drawings

PICKLING AGENT

This is a continuation-in-part of application Ser. No. 757,307, filed on July 22, 1985 now abandoned.

BACKGROUND OF THE INVENTION

1. Field Of The Invention

The invention relates to an agent for the pickling of and as an antioxidant for workpieces made of iron and/or steel which are subjected to non-cutting, hot transformation.

2. Prior Art

In the case of the production of metal sheets by rolling, of profiles in profile rollers or of seamless pipes on push-bench plants, Assel mills, plug mills, continuous mills, hot pilger mills or multiple pipe mill installations, up-setters and extrusion presses, the surfaces which are processed, for example, in the case of hollow blocks, blooms or pipes such as the inside wall surfaces of pipes, must be pickled prior to rolling in order to keep the abrasion of the tools within limits and in order to impart a good surface characteristic to the developing workpiece.

According to the experience of the art, a smooth surface can be achieved whenever the workpiece has been descaled or pickled prior to transformation. The pickling can be accomplished mechanically or with the help of pickling baths, for example, baths of sodium hydroxide. Also solid pickling agents consisting of mixtures of sodium sulfate and phosphoric acid have already been used. An additional proposal provided for the removal of scale by the application of a melting fluid mixture of sodium silicate and soda with borax or phosphates which upon cooling are supposed to break off the scale from the surface of the workpiece.

All of these processes and the descaling and pickling agents used therefor, however, are not capable of fulfilling the requirements which are made of the pickling agents, especially in an installation for the production of seamless pipes, but also in modern rolling or profile rolling installations. For example, in the case of the production of seamless pipes in the previously mentioned installations, the pickling agent must be applied and evenly distributed in the hollow space of the workpiece, which is at rolling temperature, within the operating rhythm (cycles), with the time intervals between two tubes being 15 to 180 seconds and the time necessary to introduce the product into the shell being 1 to 2 seconds, whereby a quick and reliable pickling is to be achieved in order that then immediately following such step the workpiece can be rolled out.

U.S. Pat. No. 4,039,337 (Brown et al.) discloses an aqueous dispersion which is used for release and parting in glass-forming operations. The aqueous dispersion contains a solid lubricant, a water-soluble silicate binder, a settling agent and a water-soluble phosphate.

BROAD DESCRIPTION OF THE INVENTION

An object of the invention is to provide a pickling agent in dry solid form which can be used at temperatures of above 600° to 1300° C. and which make possible the quick and reliable pickling of iron and/or steel workpieces. Another object of the invention is to provide a process using such dry, solid pickling agent for the quick and reliable pickling of iron and/or steel workpieces which are at temperatures of above 600° to 1300° C. Other objects and advantages of the invention are set out herein or are obvious herefrom to one ordinarily skilled in the art.

The objects and advantages of the invention are achieved by the agent and process of the invention.

The invention involves an agent for the pickling of and as an antioxidant for workpieces made of iron and steel in the case of when they are subjected to non-cutting, hot transformation. The invention agent is in dry form and is in solid form at room temperature. The agent contains (a) 20 to 80 percent by weight of at least one of the following pickling-effective compounds: $Na_2B_4O_7.10H_2O$, $Na_2B_4O_7.5H_2O$, anhydrous $Na_2B_4O_7$, sodium metaborate, boric acid, boric acid anhydride, soluble sodium silicate with a $SiO_2/Na_2O$ ratio of 2.5 to 3.3 and sodium metasilicate (anhydrous or having 5 or 9 molecules of waters of crystallization); (b) 1 to 80 percent by weight of at least one component of graphite, calcium fluoride, cryolite, antimony oxide, molybdenum disulfide, boron nitride, trisodium phosphate (hydrated or anhydrous), tripotassium phosphate (hydrated or anhydrous), sodium metaphosphate [$(NaPO_3)_3$ or $(NaPO_3)_4$], potassium metaphosphate [$(KPO_3)$ or $(KPO_3)_4$], polymetaphosphate, sodium tripolyphosphate (hydrated or anhydrous), sodium polyphosphate and zinc phosphate; and (c) zero to 79 percent by weight of at least one substance selected from group (d), group (e) and/or group (f). Zero to 35 percent by weight of group (d) can be used as substance (c). The substances of group (d) are additives which act as antioxidants and which influence the formation of a layer in the workpiece, e.g., a bloom. Substance (c) can be at least one of the additives of group (d) which are coke, powdery carbon, cellulose in the form of a powder, sawdust, starch, a derivative of starch, paraffin, a wax, a fatty acid, a fatty acid salt, colophonium, a derivative of colophonium, a synthetic resin based on hydrocarbons having 5 to 10 carbon atoms, a terpene resin and an indene-coumaron resin. Zero to 50 percent by weight of group (e) can be used as substance (c). The substances of group (e) are substances which control the physical characteristics of the invention agent. Substance (c) can be at least one of the substances of group (e) which are magnesium chloride ($MgCl_2.6H_2O$), sodium chloride, potassium chloride, a calcium chloride, sodium sulfate, sodium acetate, potassium actate and a clay. Zero to 5 percent by weight of group (f) can be used as substance (c). The substances of group (f) are substances which act on the reduction of the oxides of group (a) and in a separating manner. Substances (c) can be at least one of the substances of group (f) which are ammonium chloride, urea, ammonium carbonate, a urea-formaldehyde resin and sodium carbonate.

The invention agent is in a dry form, that is, it is not in a solution, slurry, dispersion, etc., form, at room temperature. No water, solvent or other liquid is added to the invention agent or used in preparing the invention agent. The invention agent is in solid form, such as, a powder or granulate, at room temperature.

The invention also involves a process for the use of the invention agents for the pickling of and as an antioxidant for workpieces made of iron or steel which are subjected to non-cutting, hot transformation. The invention process preferably is used for the pickling of and as an antioxidant for blooms made of steel which are at a rolling temperature.

DETAILED DESCRIPTION OF THE INVENTION

The substances of group (a) are active pickling agents which convert the predominantly oxidic scale components by chemical means and are solid at room temperature. Group (a) contains the following members: $Na_2B_4O_7.10H_2O$; $Na_2B_4O_7.5H_2O$; anhydrous $Na_2B_4O_7$; sodium metaborate, $NaBO_2.4H_2O$; boric acid, $H_3BO_3$; boric acid anhydride, $B_2O_3$; soluble sodium silicate with a $SiO_2/Na_2O$ ratio of 2.5 to 3.3; and sodium metasilicate, anhydrous or with 5 and 9 molecules of water of crystallization.

The substances of group (b) act as solid lubricants at the prevailing work temperature and pressure conditions. These solid substances remain on or in the workpiece. The group (b) substances are solid at room temperature. Group (b) contains the following members: graphite; calcium fluoride; cryolite, $Na_3AlF_6$; antimony oxide, $Sb_2O_3$; molybdenum disulfide, $MoS_2$; boron nitride, BN; trisodium phosphate (hydrated or anhydrous); tripotassium phosphate (hydrated or anhydrous); sodium metaphosphate [$(NaPO_3)_3$ and/or $(NaPO_3)_4$]; potassium metaphosphate [$(KPO_3)_3$ and/or $(KPO_3)_4$]; polymetaphosphate [$(NaPO_3)_4.H_2O$]; sodium tripolyphosphate [$(Na_5P_3O_{10})$]; hydrated or anhydrous; sodium polyphosphate [$(Na_5P_3O_{10})_{2-8}$]; and zinc phosphate [$(PO_4)_2Zn_3$].

The polymetaphosphate, besides the one mentioned above, can be other compounds such as those known as Madrell's salt, Graham's salt and Kurrol's salt.

The substances of group (c) are at least one substance from group (d), group (e) and/or group (f). The substances of group (c) are solid at room temperature.

The substances of group (d) cause the development of an even layer on the surface to be treated with respect to the thickness as well as to the homogeneity of the various components. This homogeneity is achieved by the melting behavior and the properties for forming films of the subsequently-mentioned substances of group (d). As a further important characteristic, the substances of group (d) at the same time have an antioxidative effect. Group (d) contains the following members: coke, powdery carbon; cellulose in powder form, sawdust; starch and its derivatives; paraffins, waxes; fatty acids and/or salts thereof; colophonium and its derivatives; and synthetic resins based on hydrocarbons having 5 to 10 carbon atoms, terpene resins and indene-coumeron resins.

The synthetic resins based on hydrocarbons having 5 to 10 carbon atoms are the so-called "hydrocarbon resins", and especially the "petroleum resins", as are defined in Kirk-Othmer, Encyclopedia Of Chemical Technology, 3rd Edition, volume 12, pp. 852 to 861, (the pertinent portions thereof being incorporated herein by reference).

The substances of group (e) influence the physical characteristics of the pickling agent, especially the melt viscosity and the melting point thereof. Group (e) contains the following members: magnesium chloride, $MgCl_2.6H_2O$; sodium chloride; potassium chloride; calcium chloride; sodium sulfate; sodium acetate; potassium acetate; and clays.

The substances of group (f) serve for the reduction of oxides, which have previously developed and are developing during the pickling process, and develop at the same time as a separating effect on the basis of their thermal decomposition and the formation of gas resulting therefrom. Group (f) contains the following members: ammonium chloride, $NH_4Cl$; urea, $CO(NH_2)_2$; ammonium carbonate, $(NH_4)_2CO_3$; urea-formaldehyde resin; and sodium carbonate, $Na_2CO_3$.

The pickling agent of the invention has a composition containing: 20 to 80 percent by weight of at least one substance of group (a); 1 to 80 percent by weight of at least one substance of group (b); and zero to 79 percent by weight of one or more substances of group (c), which is selected from groups (d), (e) and/or (f). Group (c) always contains: zero to 35 percent by weight of at least one substance of group (d); zero to 50 percent by weight of at least one substance of group (e); and/or zero to 5 percent by weight of at least one substance of group (f). Advantageously the invention pickling agent has a composition containing: 20 to 65 percent by weight of at least one substance of group (a); 5 to 75 percent by weight of at least one substance of group (b); and 5 to 75 percent by weight of one or more substances of group (c), which is selected from groups (d), (e) and/or (f). Group (c) always contains: zero to 30 percent by weight of at least one substance of group (d); zero to 30 percent by weight of at least one substance group (e); and/or zero to 3 percent by weight of at least one substance of group (f). Preferably the invention pickling agent has a composition containing: 20 to 50 percent by weight of at least one substance of group (a); 30 to 70 percent by weight of at least one substance of group (b); 10 to 50 percent by weight of one or more substances of group (c), which is selected from groups (d), (e) and/or (f). Group (c) always contains: zero to 30 percent by weight of at least one substance of group (d); zero to 30 percent by weight of at least one substance of group (e); and/or zero to 3 percent by weight of at least one substance of group (f).

The composition of the invention agents can also be selected according to the preferred intended effect.

Whenever an invention agent is to be used which, beside its antioxidative characteristics, preferably has pickling characteristics, then the composition can contain: 50 to 80 percent by weight of at least one substance of group (a); 1 to 50 percent by weight of at least one substance of group (b); and zero to 49 percent by weight, preferably 5 to 49 percent by weight, of one or more substances of group (c), which is selected from groups (d), (e) and/or (f). Group (c) always contains: zero to 35 percent by weight of at least one substance of group (d); zero to 49 percent by weight of at least one substance of group (e); and/or zero to 5 percent by weight of at least one substance of group (f).

A particularly suitable invention agent is the composition containing: 20 to 50 percent by weight of at least one substance of group (a); 50 to 80 percent by weight of at least one substance of group (b); and zero to 30 percent by weight, preferably 5 to 30 percent by weight, of one or more substances of group (c), which is selected from groups (d), (e) and/or (f). Group (c) always contains: zero to 30 percent by weight of at least one substance of group (d); zero to 30 percent by weight of at least one substance of group (e); and/or zero to 5 percent by weight of at least one substance of group (f).

Furthermore, in a preferred embodiment, the invention agent can be tailored to antioxidative characteristics, with its pickling characteristics fully preserved. The composition of such invention embodiment of the invention agent contains: 20 to 80 percent by weight of at least one substance group (a); 1 to 20 percent by weight of at least one substance of group (b); and 10 to 79 percent by weight of one or more substances of group (c), which is selected from groups (d), (e) and/or (f). Group (c) always contains: 10 to 35 percent by weight of at least one substance of group (d); zero to 50 percent by weight of at least one substance of group (e); and/or zero to 5 percent by weight of at least one substance of group (f).

A particularly preferred agent contains: 20 to 22 percent by weight of sodium metaborate as the substance of group (a) and 78 to 80 percent by weight of substances of group (b) in the form of 3 to 5 percent of graphite and 74 to 76 percent by weight of sodium tripolyphosphate.

Generally, the pickling agent is used in powder form, as a powder having an average grain size of 50 to 1000 micrometers or as a granulate having an average grain size of 0.5 to 4 mm. Depending upon the starting materials, this will be achieved by intensive grinding and/or mixing of the individual components. Also, the components of the descaling agent can be melted and then solidified by cooling, with the product obtained being ground to a powder.

The dry pickling agent is used in the form of a powder and/or as a granulate. In practice as soon as the agent comes in contact with the hot surface (600° to 1300° C.) of the workpiece, the salts melt and the salt-melt interacts with the scale and the oxides. It is believed that the borates react chemically with the scale, and that the molten silicates and phosphates work as a solvent for the scale.

The invention agent is used for pickling and as an antioxidant in the case of the non-cutting, hot transformation of iron and/or steel.

For example, metal sheets prior to rolling or profile rolling, blocks prior to extrusion, blooms in plug mills or pipes in bulldozers can be treated with the invention pickling agent. Additionally, the surfaces of workpieces to be processed in push-benches, Assel streets, continuous streets, pilgrim streets, multiple pipe mill installations, etc., can be treated with the invention pickling agent. As a rule, the agent according to the invention is sprayed in dry powder or granulate form, for example, onto a metal sheet to be rolled or sprayed into a pipe to be rolled, always in such a way that the entire surface which comes into contact with the tool, for example, the rollers or the mandrel, is covered while forming an even layer. At the same time, depending on the status of processing, the workpieces are at an operating temperature of 600° to 1300° C. or are already at their rolling temperature of 1000° to 1300° C. during the use of the invention agent. Directly after the treatment of the workpieces with the agent according to the invention, the transformation process is introduced or conducted, so intermittent cooling is neither provided nor necessary.

The invention comprises a solid agent, based on a dry mixture of at least one specific solid salt and a solid lubricant, besides different optional substances. The solid agent is preferably in the form of a powder or granulate. The salt or salt-mixture melts during use on the surface of the workpiece and the melt reacts with or desolves the scale. The resulting products do not interfere during the rolling process. Together with the solid lubricant a good protection against wear and reoxidation can be secured for the subsequent rolling step. The agent is solid at room temperature. The agent is dry in the sense that the agent does not contain any added water, solvent or other liquid and is not in the form of a dispersion, slurry, liquid, etc., at room temperature (72° F.).

By way of summary, the invention involves dry, solid, pickling agents for the pickling of workpieces made of iron and/or steel to be rolled in the area of temperatures of 600° to 1300° C. The agents contain a substance which has pickling activity, and possibly a substance which acts antioxidantly, one controlling the physical characteristics and one acting reductively. At the same time, the components can be selected such that the pickling agent has a distinctly pickling or antioxidant effect.

EXAMPLE 1

A composition of 50 percent by weight of $Na_2B_4O_7.10H_2O$ and 15 percent by weight of $Na_2B_4O_7$ as a pickling component, 30 percent by weight of a sodium stearate as a formation agent of a layer and antioxidant and 5 percent by weight of a highly crystalline synthetic graphite was processed in a mixer as powder, having a grain size of not more than 200 micrometers, into a homogenous mixture which was a pickling agent. The pickling agent was used in a plug mill during the process of a strongly scale-containing bloom.

EXAMPLE 2

A pickling agent having distinct lubricating characteristics was produced from 70 percent by weight of $Na_5P_3O_{10}$ and 4 percent by weight of graphite and 26 percent by weight of $Na_2B_2O_4.8H_2O$ (sodium metaborate) as a corroding active component, by homogenous mixing, whereby the mixture obtained had an average grain size of 100 micrometers. This finely distributed powder was sprayed directly into the hollow space of a bloom in a continuous street prior to the introduction of the mandrel bar. Thereby, the pickling took place at rolling temperature.

EXAMPLE 3

A composition of 50 percent by weight of sodium silicate (22 percent of $Na_2O$) and 20 percent by weight of sodium metaborate ($Na_2B_4O_{10}.10H_2O$), 5 percent by weight of graphite and 25 percent by weight of a mixture of sodium stearate and sodium palmitate, provided a pickling agent having distinctly antioxidative characteristics. This is shown by the relatively high portion by weight of the mixture of sodium stearate and sodium palmitate.

What is claimed is:

1. Agent for the pickling of and as an antioxidant for a workpiece made of iron and/or steel which is subjected to non-cutting, hot transformation, comprising:

(a) 20 to 80 percent by weight of one or more effective pickling compounds selected from the group consisting of: $Na_2B_4O_71OH_2O$, $Na_2B_4O_7.5H_2O$, anhydrous $Na_2B_4O_7$, $NaBO_2.4H_2O$, boric acid, boric acid anhydride, soluble sodium silicate having a $SiO_2/Na_2O$ ratio of 2.5 to 3.3, and sodium metasilicate, anhydrous or having 5 to 9 molecules of water of crystallization;

(b) 1 to 75 percent by weight of one or more dry substances selected from the group consisting of: graphite, calcium fluoride, cryolite, antimony oxide, molybdenum disulfide, boron nitride, and at least one phosphate selected from the group consisting of: hydrated or anhydrous trisodium phosphate, hydrated or anhydrous tripotassium phosphate, sodium metaphosphate, potassium metaphosphate, polymetaphosphate, hydrated or anhydrous sodium tripolyphosphate, sodium polyphosphate, and zinc phosphate.

(c) 5 to 79 percent by weight of one or more substances selected from the class consisting of group (d), group (e) and group (f);

(d) zero to 35 percent by weight of one or more additives, which act as an antioxidant and which influence the formation of a layer, of group (d) selected from the group consisting of: coke, powdery carbon, cellulose in the form of a powder, sawdust, starch or one of its derivatives, paraffin or a wax, a fatty acid and/or a salt thereof, colophonium or one of its derivatives, and a synthetic resin based on one or more hydrocarbons having 5 to 10 carbon atoms, a terpene resin, and an indene-coumaron resin;

(e) zero to 50 percent by weight of one or more substances, which control the physical characteristics of the agent, of group (e) selected from the group consisting of: magnesium chloride, sodium chloride, potassium chloride, calcium chloride, sodium sulfate, sodium acetate, potassium acetate and a clay; and (f) zero to 5 percent by weight of one or more substances, which act on the reduction of the oxide of group (a) and act in a separating manner, of group (f) selected from the group consisting of: ammonium chloride, urea, ammonium carbonate, a urea-formaldehyde resin and sodium carbonate, said agent being in dry form having no added liquid and being solid at room temperature.

2. Agent claimed in claim 1 wherein the agent contains 20 to 65 percent by weight of at least one substance of group (a), 5 to 75 percent by weight of at least one substance of group (b) and 5 to 63 percent by weight of at least one substance of group (c), group (c) containing zero to 30 percent by weight of at least one substance of group (d), zero to 30 percent by weight of at least one substance of group (e) and/or zero to 3 percent by weight of at least one substance of group (f).

3. Agent as claimed in claim 2 wherein the agent contains 20 to 50 percent by weight of at least one substance group (a), 30 to 70 percent by weight of at least one substance of group (b), and 10 to 50 percent by weight of at least one substance of group (c), group (c) containing zero to 30 percent by weight of at least one substance of group (d), zero to 30 percent by weight of at least one substance of group (e) and/or zero to 3 percent by weight of at least one substance of group (f).

4. Agent for the pickling of and as an antioxidant for a workpiece made of iron and/or steel which is subjected to non-cutting, hot transformation, comprising:

(a) 50 to 80 percent by weight of one or more effective pickling compounds selected from the group consisting of: $Na_2B_4O_7.10H_2O$, $Na_2B_4O_7.5H_2O$, anhydrous $Na_2B_4O_7$, $NaBO_2.4H_2O$, boric acid, boric acid anhydride, soluble sodium silicate having a $SiO_2/Na_2O$ ratio of 2.5 to 3.3, and sodium metasilicate, anhydrous or having 5 to 9 molecules of water of crystallization;

(b) 1 to 50 percent by weight of one or more dry substances selected from the group consisting of: graphite, calcium fluoride, cryolite, antimony oxide, molybdenum disulfide, boron nitride, and at least one phosphate selected from the group consisting of: hydrated or anhydrous trisodium phosphate, hydrated or anhydrous tripotassium phosphate, sodium metaphosphate, potassium metaphosphate, polymetaphosphate, hydrated or anhydrous sodium tripolyphosphate, sodium polyphosphate, and zinc phosphate;

(c) 5 to 49 percent by weight of one or more substances selected from the class consisting of group (d), group (e) and group (f);

(d) zero to 35 percent by weight of one or more additives, which act as an antioxidant and which influence the formation of a layer, of group (d) selected from the group consisting of: coke, powdery carbon, cellulose in the form of a powder, sawdust, starch or one of its derivatives, paraffin or a wax, a fatty acid and/or a salt thereof, colophonium or one of its derivatives, and a synthetic resin based on one or more hydrocarbons having 5 to 10 carbon atoms, a terpene resin, and an indene-coumaron resin;

(e) zero to 49 percent by weight of one or more substances, which control the physical characteristics of the agent, of group (e) selected from the group consisting of: magnesium chloride, sodium chloride, potassium chloride, calcium chloride, sodium sulfate, sodium acetate, potassium acetate and a clay; and (f) zero to 5 percent by weight of one or more substances, which act on the reduction of the oxide of group (a) and act in a separating manner, of group (f) selected from the group consisting of: ammonium chloride, urea, ammonium carbonate, a urea-formaldehyde resin and sodium carbonate, said agent being in dry form having no added liquid and being solid at room temperature.

5. Agent as claimed in claim 4 wherein the agent contains 5 to 49 percent by weight of at least one substance of group (c).

6. Agent for the pickling of and as an antioxidant for a workpiece made of iron and/or steel which is subjected to non-cutting, hot transformation, comprising:

(a) 20 to 50 percent by weight of one or more effective pickling compounds selected from the group consisting of: $Na_2B_4O_7.10H_2O$, $Na_2B_4O_7.5H_2O$, anhydrous $Na_2B_4O_7$, $NaBO_2.4H_2O$, boric acid, boric acid anhydride, soluble sodium silicate having a $SiO_2/Na_2O$ ratio of 2.5 to 3.3, and sodium metasilicate, anhydrous or having 5 to 9 molecules of water of crystallization;

(b) 50 to 80 percent by weight of one or more dry substances selected from the group consisting of: graphite, calcium fluoride, cryolite, antimony oxide, molybdenum disulfide, boron nitride, and at least one phosphate selected from the group consisting of: hydrated or anhydrous trisodium phosphate, hydrated or anhydrous tripotassium phosphate, sodium metaphosphate, potassium metaphosphate, polymetaphosphate, hydrated or anhydrous sodium tripolyphosphate, sodium polyphosphate, and zinc phosphate;

(c) 5 to 30 percent by weight of one or more substances selected from the class consisting of group (d), group (e) and group (f);

(d) zero to 30 percent by weight of one or more additives, which act as an antioxidant and which influence the formation of a layer, of group (d) selected from the group consisting of: coke, powdery carbon, cellulose in the form of a powder, sawdust, starch or one of its derivatives, paraffin or a wax, a fatty acid and/or a salt thereof, colophonium or one of its derivatives, and a synthetic resin based on one or more hydrocarbons having 5 to 10 carbon atoms, a terpene resin, and an indene-coumaron resin;

(e) zero to 30 percent by weight of one or more substances, which control the physical characteristics of the agent, or group (e) selected from the group consisting of: magnesium chloride, sodium chloride, potassium chloride, calcium chloride, sodium sulfate, sodium acetate, potassium acetate and a clay; and (f) zero to 5 percent by weight of one or more substances, which act on the reduction of the oxide of group (a) and act in a separating manner, of group (f) selected from the group consisting of: ammonium chloride, urea, ammonium carbonate, a urea-formaldehyde resin and sodium carbonate, said agent being in dry form having no added liquid and being solid at room temperature.

7. Agent as claimed in claim 6 wherein the agent contains 5 to 30 percent by weight of at least one substance of group (c).

8. Agent as claimed in claim 6 wherein the agent contains 20 to 22 percent by weight of sodium metaborate and 78 to 80 percent by weight of a substance of group (b) in the form of 3 to 5 percent by weight of graphite and 74 and 76 percent by weight of sodium tripolyphosphate.

9. Agent for the pickling of and as an antioxidant for a workpiece made of iron and/or steel which is subjected to non-cutting, hot transformation, comprising:

(a) 20 to 80 percent by weight of one or more effective pickling compounds selected from the group consisting of: $Na_2B_4O_7.10H_2O$, $Na_2B_4O_7.5H_2O$, anhydrous $Na_2B_4O_7$, $NaBO_2.4H_2O$, boric acid, boric acid anhydride, soluble sodium silicate having a $SiO_2/Na_2O$ ratio of 2.5 to 3.3, and sodium metasilicate, anhydrous or having 5 to 9 molecules of water of crystallization;

(b) 1 to 20 percent by weight of one or more dry substances selected from the group consisting of: graphite, calcium fluoride, cryolite, antimony oxide, molybdenum disulfide, boron nitride, and at least one phosphate selected from the group consisting of: hydrated or anhydrous trisodium phosphate, hydrated or anhydrous tripotassium phosphate, sodium metaphosphate, potassium metaphosphate, polymetaphosphate, hydrated or anhydrous sodium tripolyphosphate, sodium polyphosphate, and zinc phosphate.

(c) 10 to 79 percent by weight of one or more substances selected from the class consisting of group (d), group (e) and group (f);

(d) 10 to 35 percent by weight of one or more additives, which act as an antioxidant and which influence the formation of a layer, of group (d) selected from the group consisting of: coke, powdery carbon, cellulose in the form of a powder, sawdust, starch or one of its derivatives, paraffin or wax, a fatty acid and/or a salt thereof, colophonium or one of its derivatives, and a synthetic resin based on one or more hydrocarbons having 5 to 10 carbon atoms, a terpene resin, and an indene-coumaron resin;

(e) zero to 50 percent by weight of one or more substances, which control the physical characteristics of the agent, of group (e) selected from the group consisting of: magnesium chloride, sodium chloride, potassium chloride, calcium chloride, sodium sulfate, sodium acetate, potassium acetate and a clay; and (f) zero to 5 percent by weight of one or more substances, which act on the reduction of the oxide of group (a) and act in a separating manner, of group (f) selected from the group consisting of: ammonium chloride, urea, ammonium carbonate, a urea-formaldehyde resin and sodium carbonate, said agent being in dry form having no added liquid and being solid at room temperature.

10. Agent as claimed in claim 9 wherein the workpiece is at a temperature of 600° to 1300° C.

11. Agent as claimed in claim 10 wherein the workpiece is at a temperature of 1000° to 1300° C.

12. Agent for the pickling of and as an antioxidant for a workpiece made of iron and/or steel which is subjected to non-cutting, hot transformation, comprising:

(a) 20 to 80 percent by weight of one or more effective pickling compounds selected from the group consisting of: $Na_2B_4O_7.10H_2O$, $Na_2B_4O_7.5H_2O$, anhydrous $Na_2B_4O_7$, $NaBO_2.4H_2O$, boric acid, boric acid anhydride, soluble sodium silicate having a $SiO_2/Na_2O$ ratio of 2.5 to 3.3, and sodium metasilicate, anhydrous or having 5 to 9 molecules of water of crystallation;

(b) 1 to 80 percent by weight of one or more dry substances selected from the group consisting of: graphite, calcium fluoride, cryolite, antimony oxide, molybdenum disulfide, boron nitride, and at least one phosphate selected from the group consisting of: hydrated or anhydrous trisodium phosphate, hydrated or anhydrous tripotassium phosphate, sodium metaphosphate, potassium metaphosphate, polymetaphosphate, hydrated or anhydrous sodium tripolyphosphate, sodium, polyphosphate, and zinc phosphate.

(c) 5 to 79 percent by weight of one or more substances selected from the class consisting of group (d), group (e) and group (f);

(d) zero to 35 percent by weight of one or more additives, which act as an antioxidant and which influence the formation of a layer, of group (d) selected from the group consisting of: coke, powdery carbon, cellulose in the form of a powder, sawdust, starch or one of its derivatives, paraffin or a wax, a fatty acid and/or a salt thereof, colophonium or one of its derivatives, and a synthetic resin based on one or more hydrocarbons having 5 to 10 carbon atoms, a terpene resin, and an indene-coumaron resin, (e) zero to 50 percent by weight of one or more substances, which control the physical characteristics of the agent, of group (e) selected from the group consisting of: magnesium chloride, sodium chloride, potassium chloride, calcium chloride, sodium sulfate, sodium acetate and potassium acetate, and (f) zero to 5 percent by weight of one or more substances, which act on the reduction of the oxide of group (a) and act in a separating manner, of group (f) selected from the group consisting of: ammonium chloride, urea, ammonium carbonate and a urea-formaldehyde resin, said agent being in dry form, having no added liquid and being solid at room temperature.

13. Agent claimed in claim 12 wherein the agent contains 20 to 80 percent by weight of at least one substance of group (a), 1 to 75 percent by weight of at least one substance of group (b) and 5 to 79 percent by weight of at least one substance of group (c), group (c) containing zero to 35 percent by weight of at least one substance of group (d), zero to 50 percent by weight of at least one substance of group (e), and/or zero to 5 percent by weight of at least one substance of group (f).

14. Agent claimed in claim 13 wherein the agent contains 20 to 65 percent by weight of at least one substance of group (a), 5 to 75 percent by weight of at least one substance of group (b) and 5 to 75 percent by weight of at least one substance of group (c), group (c) containing zero to 30 percent by weight of at least one substance of group (d), zero to 30 percent by weight of at least one substance of group (e) and/or zero to 3 percent by weight of at least one substance of group (f).

15. Agent as claimed in claim 14 wherein the agent contains 20 to 50 percent by weight of at least one substance of group (a), 30 to 70 percent by weight of at least one substance of group (b), and 10 to 50 percent by weight of at least one substance of group (c), group (c) containing zero to 30 percent by weight of at least one substance of group (d), zero to 30 percent by weight of at least one substance of group (d) and/or zero to 3 percent by weight of at least one substance of group (f).

16. Agent as claimed in claim 12 wherein the agent contains 50 to 80 percent by weight of at least one substance of group (a), 1 to 50 percent by weight of at least one substance of group (b), and 5 to 49 percent by weight of at least one substance of group (c), group (c) containing zero to 35 percent by weight of at least one substance of group (d), zero to 49 percent by weight of at least one substance of group (e), and/or zero to 5 percent by weight of at least one substance of group (f).

17. Agent as claimed in claim 12 wherein the agent contains 20 to 50 percent by weight of at least one substance of group (a), 50 to 80 percent by weight of at least one substance of group (b), and zero to 30 percent by weight of at least one substance of group (c), group (c) containing 5 to 30 percent by weight of at least one substance of group (d), zero to 30 percent by weight of at least one substance of group (e), and/or zero to 5 percent by weight of at least one substance of group (f).

18. Agent as claimed in claim 17 wherein the agent contains 20 to 22 percent by weight of sodium metaborate and 78 to 80 percent by weight of a substance of group (b) in the form of 3 to 5 percent by weight of graphite and 74 to 76 percent by weight of sodium tripolyphosphate.

19. Agent as claimed in claim 12 wherein the agent contains 20 to 80 percent by weight of at least one substance of group (a), 1 to 20 percent by weight of at least one substance of group (b), and 10 to 79 percent by weight of at least one substance of group (c), group (c) containing 10 to 35 percent by weight of at least one substance of group (d), zero to 50 percent by weight of at least one substance of group (e) and/or zero to 5 percent by weight of at least one substance of group (f).

20. Agent as claimed in claim 19 wherein the workpiece is at a temperature of 600° to 1300° C.

21. Agent as claimed in claim 20 wherein the workpiece is at a temperature of 1000° to 1300° C.

22. Agent as claimed in claim 12 wherein the workpiece is at a temperature of 600° to 1300° C.

23. Agent as claimed in claim 22 wherein the workpiece is at a temperature of 1000° to 1300° C.

24. Process comprising using the agent of claim 12 for the pickling of and as an antioxidant for a workpiece made of iron and/or steel in a non-cutting, hot transformation.

25. Process comprising using the agent of claim 12 for the pickling of and as an antioxidant for a bloom made of steel at a rolling temperature.

26. Process comprising using the agent of claim 12 for the pickling of and as an antioxidant of a bloom made of steel at a rolling temperature in a plug mill.

27. Process comprising using the agent of claim 12 for the pickling of, for the lubrication of and as an antioxidant for a workpiece at a temperature of 600° to 1300° C.

28. Process as claimed in claim 27 wherein the workpiece is at a temperature of 1000° to 1300° C.

* * * * *